US012628880B2

(12) United States Patent
Marchbank et al.

(10) Patent No.: US 12,628,880 B2
(45) Date of Patent: May 19, 2026

(54) AEROSOL DELIVERY DEVICE/SYSTEM

(71) Applicant: Nerudia Limited, Bristol (GB)

(72) Inventors: Jonathan Marchbank, Bristol (GB); Thomas Sudlow, Bristol (GB); David Thomas, Bristol (GB); Oliver Talbot, Bristol (GB); Peter Lomas, Bristol (GB); Molly McGuinness, Bristol (GB); Carlos Fabrellas-Garcia, Bristol (GB)

(73) Assignee: Imperial Tobacco Limited, Bristol (GB)

( * ) Notice: Subject to any disclaimer, the term of this patent is extended or adjusted under 35 U.S.C. 154(b) by 682 days.

(21) Appl. No.: 17/944,877

(22) Filed: Sep. 14, 2022

(65) Prior Publication Data

US 2023/0081088 A1 Mar. 16, 2023

(30) Foreign Application Priority Data

Sep. 15, 2021 (EP) ..... 21196938
Sep. 15, 2021 (EP) ..... 21196981

(51) Int. Cl.
*A24F 40/60* (2020.01)
*A24F 40/51* (2020.01)
*A24F 40/90* (2020.01)

(52) U.S. Cl.
CPC ..... *A24F 40/60* (2020.01); *A24F 40/51* (2020.01); *A24F 40/90* (2020.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 6,046,597 | A | 4/2000 | Barabi | |
| 2013/0042865 | A1* | 2/2013 | Monsees | A24F 40/53 128/203.27 |
| 2016/0158782 | A1* | 6/2016 | Henry, Jr. | A24F 40/53 700/275 |
| 2016/0345636 | A1 | 12/2016 | Liu | |
| 2016/0366933 | A1 | 12/2016 | Liu | |
| 2017/0064793 | A1 | 3/2017 | Liu | |
| 2019/0082741 | A1 | 3/2019 | Verleur et al. | |
| 2019/0099561 | A1 | 4/2019 | Nettenstrom | |
| 2019/0387801 | A1* | 12/2019 | Takeuchi | A24F 40/53 |
| 2019/0387803 | A1* | 12/2019 | Yamada | A24F 40/95 |
| 2020/0297030 | A1 | 9/2020 | Newcomb et al. | |
| 2020/0350773 | A1* | 11/2020 | Fernando | A24F 40/65 |

FOREIGN PATENT DOCUMENTS

| | | | |
|---|---|---|---|
| CN | 204304050 | U | 4/2015 |
| CN | 207803444 | U | 9/2018 |
| EP | 3689165 | A1 | 8/2020 |

(Continued)

*Primary Examiner* — Phuong K Dinh
(74) *Attorney, Agent, or Firm* — Dykema Gossett PLLC

(57) ABSTRACT

The present disclosure relates to an aerosol delivery device and system e.g. a smoking substitute device and system. In particular an aerosol delivery device comprising: a movement detection unit configured to detect a movement of the device; a power source having a charge status; and a feedback element configured to provide feedback based on the charge status of the power source wherein the feedback element provides feedback in response to a movement of the device detected by the movement detection unit.

15 Claims, 9 Drawing Sheets

(56) References Cited

FOREIGN PATENT DOCUMENTS

| | | | |
|---|---|---|---|
| EP | 3432957 | B1 | 3/2021 |
| EP | 3838025 | A1 | 6/2021 |
| WO | 2017/163045 | A1 | 9/2017 |
| WO | 2020/249789 | A1 | 12/2020 |
| WO | 2021/089855 | A1 | 5/2021 |

* cited by examiner

AEROSOL DELIVERY DEVICE/SYSTEM

TECHNICAL FIELD

The present disclosure relates to an aerosol delivery device and an aerosol delivery system such as a smoking substitute device/system.

BACKGROUND

The smoking of tobacco is generally considered to expose a smoker to potentially harmful substances.

It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute systems are intended to provide a substitute for the rituals of smoking, whilst providing the user with a similar experience and satisfaction to those experienced with traditional smoking and tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. Some smoking substitute systems are designed to resemble a traditional cigarette and are cylindrical in form with a mouthpiece at one end. Other smoking substitute systems do not generally resemble a cigarette (for example, the smoking substitute device may have a generally box-like form).

There are a number of different categories of smoking substitute systems, each utilizing a different smoking substitute approach. A smoking substitute approach corresponds to the manner in which the substitute system operates for a user.

One approach for a smoking substitute system is the so-called "vaping" approach, in which a vaporisable liquid, typically referred to (and referred to herein) as "e-liquid", is heated by a heater to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerine.

A typical vaping smoking substitute system includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapour") which is inhaled by a user through the mouthpiece.

Vaping smoking substitute systems can be configured in a variety of ways. For example, there are "closed system" vaping smoking substitute systems which typically have a heater and a sealed tank which is pre-filled with e-liquid and is not intended to be refilled by an end user. One subset of closed system vaping smoking substitute systems include a device which includes the power source, wherein the device is configured to be physically and electrically coupled to a component including the tank and the heater. In this way, when the tank of a component has been emptied, the device can be reused by connecting it to a new component. Another subset of closed system vaping smoking substitute systems are completely disposable, and intended for one-use only.

There are also "open system" vaping smoking substitute systems which typically have a tank that is configured to be refilled by a user, so the system can be used multiple times.

An example vaping smoking substitute system is the Myblu™ e-cigarette. The Myblu™ e cigarette is a closed system which includes a device and a consumable component. The device and consumable component are physically and electrically coupled together by pushing the consumable component into the device. The device includes a rechargeable battery. The consumable component includes a mouthpiece, a sealed tank which contains e-liquid, as well as a vaporizer, which for this system is a heating filament coiled around a portion of a wick which is partially immersed in the e-liquid. The system is activated when a microprocessor on board the device detects a user inhaling through the mouthpiece. When the system is activated, electrical energy is supplied from the power source to the vaporizer, which heats e-liquid from the tank to produce a vapour which is inhaled by a user through the mouthpiece.

Another example vaping smoking substitute system is the blu PRO™ e-cigarette. The blu PRO™ e cigarette is an open system which includes a device, a (refillable) tank, and a mouthpiece. The device and tank are physically and electrically coupled together by screwing one to the other. The mouthpiece and refillable tank are physically coupled together by screwing one into the other, and detaching the mouthpiece from the refillable tank allows the tank to be refilled with e-liquid. The system is activated by a button on the device. When the system is activated, electrical energy is supplied from the power source to a vaporizer, which heats e-liquid from the tank to produce a vapour which is inhaled by a user through the mouthpiece.

An alternative to the "vaping" approach is the so-called Heated Tobacco ("HT") approach in which tobacco (rather than an e-liquid) is heated or warmed to release vapour. HT is also known as "heat not burn" ("HNB"). The tobacco may be leaf tobacco or reconstituted tobacco. In the HT approach the intention is that the tobacco is heated but not burned, i.e. the tobacco does not undergo combustion.

The heating, as opposed to burning, of the tobacco material is believed to cause fewer, or smaller quantities, of the more harmful compounds ordinarily produced during smoking. Consequently, the HT approach may reduce the odour and/or health risks that can arise through the burning, combustion and pyrolytic degradation of tobacco.

A typical HT smoking substitute system may include a device and a consumable component. The consumable component may include the tobacco material. The device and consumable component may be configured to be physically coupled together. In use, heat may be imparted to the tobacco material by a heating element of the device, wherein airflow through the tobacco material causes components in the tobacco material to be released as vapour. A vapour may also be formed from a carrier in the tobacco material (this carrier may for example include propylene glycol and/or vegetable glycerine) and additionally volatile compounds released from the tobacco. The released vapour may be entrained in the airflow drawn through the tobacco.

As the vapour passes through the consumable component (entrained in the airflow) from the location of vaporization to an outlet of the component (e.g. a mouthpiece), the vapour cools and condenses to form an aerosol for inhalation by the user. The aerosol may contain nicotine and/or flavour compounds.

It is known to provide smoking substitute systems with a means of indicating to the user the level of charge remaining within the power source within during use. This is typically provided by an LED which lights up during inhalation through the device. The user is not easily able to check the charge level when not inhaling on the device.

It is also known to provide a means of indicating to the user that the device is charging and this may also comprise an LED. For users who charge their devices overnight, the illuminated LED can provide an unwelcome light source.

Accordingly, there is a need for an improved aerosol delivery device/system which addresses at least some of the problems of the known devices and systems.

SUMMARY

According to a first aspect, there is provided an aerosol delivery device (e.g. a smoking substitute device) comprising:

- a movement detection unit configured to detect a movement of the device;
- a power source having a level of charge; and
- a feedback element configured to provide feedback based on the charge status of the power source wherein the feedback element provides feedback in response to a movement of the device detected by the movement detection unit.

Such a smoking substitute device can more easily indicate the charge status of the power source to the user, even when the device is not in use. In particular, the feedback element can provide useful information about the power source when the device is simply moved by the user. Thus, the feedback element ensures that status information, which is of key importance to the user, is easily and conveniently communicated without requiring activation of/inhalation upon the device.

Optional features will now be set out. These are applicable singly or in any combination with any aspect.

In some embodiments, the device may be configured to operate in a charging mode and the feedback element may be configured to provide feedback in response to the movement of the device when the device is in the charging mode e.g. only when the device is in the charging mode.

The feedback element may be configured to prohibit the provision of feedback when no movement is detected e.g. when the device is in the charging mode and no movement is detected. In this way, if the device is charged overnight, there is no light pollution unless the user chooses to move the device.

The feedback element is configured to provide feedback based on the charge status of the power source. The charge status may be indicative of the current level of charge of the power source, or a change (i.e. an increase or decrease) in the level of charge of the power source.

The movement detection unit may comprise an accelerometer. The movement detection unit may comprise one or more tilt switches and/or one or more g-sensors.

The movement detection unit may be configured to detect and/or measure a defined movement e.g. a defined movement having a movement parameter. The defined movement may be indicative of the device being picked up, tapped or moved by the user. The movement parameter may be indicative of an external force that is exerted upon the device. The feedback element may be configured to provide feedback when the movement parameter is above a predetermined movement threshold. The movement detection unit may be calibrated to avoid unwanted activation of the feedback element, in order to ignore physical stimuli below the predetermined movement threshold. In this way, the movement detection unit may be configured to ignore extraneous and/or accidental device movements.

The feedback element may comprise a feedback controller configured to control the feedback element. Detection of a defined movement (e.g. a defined movement having a movement parameter above the predetermined movement threshold) may cause the movement detection unit to generate a signal which is detected by the controller which, in turn, is configured to send a signal to cause the feedback element to provide feedback relating to the current charge status of the power source.

The feedback element may comprise at least one visual feedback element configured to provide visual feedback to the user.

The visual feedback element may comprise at least one light source, for example one or more lights e.g. one or more LEDs. The feedback controller may be configured to control the light source to produce illuminations having different colours and/or intensities and/or durations, in order to indicate a change in the charge level of the power source.

The visual feedback element (e.g. the light source) may be controlled (e.g. by the feedback controller) to produce a first illumination when the level of charge of the power source is above a first predetermined charge threshold (e.g. above 50% charge level), and produce a second illumination when the level of charge is below the charge threshold. By varying the illumination based on the determined charge level of the power source, the feedback element can provide an intuitive means of indicating the charge level to the user.

The light source may be controlled so that the first and second illuminations are different colours. The light source may be controlled so that the first and second illuminations are of different intensities. The light source may be controlled so that at least one of the first and second illuminations comprises a pulsed illumination. The light source may be controlled so that the first illumination is pulsed at a first frequency and the second illumination is pulsed at a second frequency, wherein the first pulse frequency is greater than the second pulse frequency.

The visual feedback element (e.g. the light source) may be controlled (e.g. by the feedback controller) to produce a third illumination when the power source charge level is substantially full i.e. at substantially 100%.

The visual feedback element (e.g. the light source) may be controlled (e.g. by the feedback controller) to produce a fourth illumination when the power source charge level is below a second predetermined charge threshold (e.g. around 20% charge level) which is less than the first predetermined charge threshold.

The third and/or fourth illumination(s) may be different colours and/or intensities and/or may pulse for different durations than each other and then the first and second illuminations.

By way of example, the visual feedback element (e.g. light source) may be controlled (e.g. by the feedback controller), when the charge status of the power source is at substantially 100%, to provide the third illumination comprising a green illumination e.g. solid, or continuous, green illumination. When the charge status of the power source is substantially between 50% and 99%, then the light source may be controlled provide the first illumination comprising a pulsed green light. In situations where the charge status of the power source is substantially between 20% and 50%, the light source may be controlled to provide the second illumination comprising a pulsed yellow light. When the charge status of the power source is substantially between 0% and 19%, then the light source may be controlled to produce the fourth illumination comprising a pulsed red illumination.

The feedback element may be configured to provide feedback for a predetermined period of time (e.g. 10 seconds, or 5 seconds or 3 seconds) before turning off. The predetermined period of illumination may be calibrated so that the user, having identified that the device is charging, can return to sleep quickly without being disturbed by continued illumination from the device. By turning off the feedback response after a period of time, the feedback element may also increase the user's perception that the device is not using power on extraneous functionalities, which is important to a user of such devices.

The device further comprises the source of power which may be a battery. The source of power may be a capacitor. The power source may be a rechargeable power source. The device may comprise a charging connection for connection to an external power supply for recharging of the power source within the device.

The visual user feedback element may be arranged at the front and/or rear surface of the device body. In some embodiments, the device body may include an illumination region configured to allow light provided by the visual user feedback element (e.g. one or more lights/LEDs) within the device body to shine through.

The feedback element may comprise a haptic feedback generation unit (e.g. an electric motor and a weight mounted eccentrically on a shaft of the electric motor), configured to provide haptic feedback based on the charge status of the power source.

The device may include a controller. The controller may comprise, or be defined by, the feedback controller which is configured to control the operation of the feedback element.

The controller may be configured to identify an operation of the device; and control the one or more lights contained within the device body, (e.g. to illuminate the illumination region) based on the charge status of the power source.

The controller may be configured to control the haptic feedback generation unit to generate the haptic feedback in response to the detection of movement of the device by the movement detection unit.

A memory may be provided and may be operatively connected to the controller. The memory may include non-volatile memory. The memory may include instructions which, when implemented, cause the controller to perform certain tasks or steps of a method. As discussed above, the visual feedback may be selected from a plurality of different visual feedback responses (i.e. illuminations) which may be stored in the memory.

According to a second aspect, there is provided an aerosol delivery device (e.g. a smoking substitute device) comprising at least one connector pin, the connector pin having a main body, a first head for electrical connection to an aerosol delivery component comprising a vaporizer, and a second head for electrical connection to an electrical component within the device, wherein both the first and second heads are biased to extend from the main body.

By providing an aerosol delivery device having a connector pin which has both first and second heads biased to extend from the main body, the first and second heads of the connector pin may each impart a compressive force to surfaces which they abut. This may ensure that the connector pin is in reliable electrical connection with the surfaces it abuts e.g. in reliable connection with an electrical interface in the aerosol delivery component and/or with an electrical interface within the device (e.g. for connection to a device power source and/or a device PCB). Consequently, there is a reduced need for soldering or for additional wires when assembling the aerosol delivery device. This may reduce the complexity of the assembly process (i.e. it may reduce the number of assembly operations) and may reduce the number of materials used in the assembly process. Further, providing such a connector pin may reduce the time taken to assemble the aerosol delivery device.

The main body of the connector pin may be an elongate rod-like element of any transverse cross-sectional shape. The connector pin (i.e. the main body) may have a longitudinal axis extending the length of the connector pin. The main body may extend axially between the first and second head portions. The first and second heads may be at opposite longitudinal ends of the main body of the connector pin.

In some embodiments, the main body may have a circular transverse cross-sectional area. In embodiments where the main body has a circular transverse cross-sectional area, the main body has a main body diameter. In some embodiments, the main body may be solid. In other embodiments, the main body may be at least partly hollow.

The first head may comprise a substantially cylindrical portion and a first longitudinal head end face. There may be an angled portion extending between the first head cylindrical portion and the first head end face.

The second head may comprises a substantially cylindrical portion and a second longitudinal head end face. There may be an angled portion extending between the second head cylindrical portion and the second head end face.

The first head end face may be substantially parallel to the second head end face and substantially perpendicular to the longitudinal axis of the connector pin.

The main body may have a first longitudinal body end face proximate the first head. The first body end face may be substantially parallel to the first head end face. The first body end face may comprise a first body aperture. The main body may have a second longitudinal body end face proximate the second head. The second body end face may be substantially parallel to the second head end face. The second body end face may comprise a second body aperture.

The first head may be biased e.g. resiliently biased to extend from the first body end face away from the main body of the connector pin. More specifically, the first head may extend through the first body aperture away from the first body end face such that the first head is at least partly exposed (i.e. the first head end face may be longitudinally spaced from the first body end face). The first head may be axially aligned with the main body i.e. a longitudinally extending axis of the first head may be substantially collinear with the longitudinal axis of the main body of the connector pin. The first head may have a circular transverse cross-sectional area.

The second head may be biased e.g. resiliently biased to extend from the second body end face away from the main body of the connector pin. More specifically, the second head may extend through the second body aperture away from the second body end face such that the second head is at least partly exposed (i.e. the second head end face may be longitudinally spaced from the second body end face). The second head may be axially aligned with the main body i.e. a longitudinally extending axis of the second head may be substantially collinear with the longitudinal axis of the main body of the connector pin. The second head may have a circular transverse cross-sectional area.

The first head is biased e.g. resiliently biased towards an extended position. The first head may be movable against the bias to a retracted position. In the extended position, the first head end face and the main body may be spaced further apart than in the retracted position. In other words, in the extended position, the first head end face and the first body end face may be longitudinally spaced further apart than in the retracted position. More specifically, in the extended position, the first head end face and the first body end face are longitudinally spaced at the maximum distance apart.

The second head is biased e.g. resiliently biased towards an extended position. The second head may be movable against the bias to a retracted position. In the extended position, the second head end face and the main body are spaced further apart than in the retracted position. In other words, in the extended position, the second head end face and the second body end face may be longitudinally spaced further apart than in the retracted position. More specifically, in the extended position, the second head end face and the second body end face are longitudinally spaced at the maximum distance apart.

The connector pin comprises a first biasing element to bias the first head towards its extended position. Similarly, the connector pin further comprises a second biasing element to bias the second head towards its extended position.

As a result of the first and second heads being biased towards their extended positions, the first and second heads of the connector pin may each impart a compressive force to surfaces which they abut. This may result in a more stable electrical connection between the surfaces and the connector pin.

The first head may be hollow. The first biasing element may be located at least partly inside the first head. The second head may be hollow. The second biasing element may be located at least partly inside the second head. The first and/or second biasing element(s) may be located at least partly in the main body of the connector pin. The first and/or second biasing element(s) may be a resilient material or a spring i.e. the first and/or second head(s) may be spring-loaded.

The connector pin may comprise a constraining feature which prevents axial movement of the connector pin relative to the aerosol delivery device. More specifically the main body may comprise the constraining feature. Consequently, the connector pin can be constrained within the device as discussed below.

In some embodiments, the constraining feature is a radially protruding flange. In other words, the main body of the connector pin may comprise a radially protruding flange. The flange may extend around at least part of the exterior of the main body of the connector pin. The flange may fully extend around the exterior of the main body.

In embodiments where the main body has a circular transverse cross-sectional area, the flange may be a circumferential flange. The flange may be proximate the second head end face of the connector pin. The flange may have a flange thickness in the first longitudinal direction. The flange may have a flange diameter.

The flange may have a first flange face which faces away from the second head of the connector pin and towards the first head of the connector pin. The flange may have a second flange face which faces away from the first head of the connector pin and towards the second head of the connector pin. The first and second flange faces may be substantially parallel. The first and second flange faces may be transverse i.e. approximately perpendicular to the longitudinal axis of the connector pin.

The radially protruding flange may prevent movement of the main body of the connector pin in the first longitudinal direction. Consequently, the connector pin can be constrained within the device as discussed below.

The connector pin may comprise a radially protruding rib. More specifically, the main body of the connector pin may comprise a radially protruding rib. The rib may extend around at least part of the exterior of the main body of the connector pin. The rib may fully extend around the exterior of the main body. In embodiments where the main body has a circular transverse cross-sectional area, the rib may be a circumferential rib. The rib may be more proximate the first head than the flange.

The rib may have a rib diameter. The rib diameter may be smaller than the flange diameter. The rib may have a rib thickness in the first longitudinal direction. The rib thickness may be smaller than the flange thickness. The rib may comprise an outer face which faces a direction transverse to the longitudinal axis of the connector pin. In embodiments where the main body has a circular cross-sectional area, the outer face of the rib faces radially outward.

In embodiments where the connector pin is inserted into a bore of a socket plate (as discussed below), the rib may improve the adherence of the main body of the connector pin to the bore. In other words, the rib may improve or create an interference fit between the connector pin and the socket plate.

In some embodiments, the main body may have a transverse cross sectional area which is approximately constant along the length of the main body. In other embodiments the main body may have a stepped transverse cross-sectional area. For example, the main body may have a first transverse cross-sectional area between the first head and the constraining feature and may have a second transverse cross-sectional area between the constraining feature and the second head. In these embodiments, the second transverse cross-sectional area may be larger than the first transverse cross-sectional area.

In some embodiments, the main body may comprise a fillet. For example, a radially outer edge of the first body end face may comprise a first fillet. In embodiments where the main body has a circular transverse cross-sectional area, the first body end face may comprise a circumferential first fillet. Alternatively or in addition, an outer edge of the second body end face may comprise a second fillet. In embodiments where the main body has a circular transverse cross-sectional area, the second body end face may comprise a circumferential second fillet.

The first fillet may improve the insertion of the connector pin into the bore of the socket plate (as discussed below).

The device may comprise a socket plate. The socket plate may be at an upper end of a device body. The socket plate is configured to be releasably engageable with the aerosol delivery component. The socket plate may comprise at least one socket plate bore. The socket plate bore may extend through a thickness of the socket plate in a longitudinal direction parallel with a longitudinal axis of the device. The socket plate may comprise a lower transverse socket plate face. The socket plate may comprise an upper transverse socket place face spaced from the lower socket plate face. The upper socket plate face may comprise a plurality of recesses.

The at least one connector pin may extend within a respective one of the at least one socket plate bore. The first head may extend at least partly above the upper socket plate face. The first body end face may be approximately aligned with the upper socket plate face i.e. the first body end face and the upper socket plate face may be approximately coplanar. For example, the first body end face and the upper socket plate face may be coplanar.

In embodiments where the main body of the connector pin has a circular transverse cross-sectional area, the socket plate bore may have a bore diameter which is larger than the main body diameter. Alternatively, the bore diameter may be smaller than the main body diameter. Alternatively still, the bore diameter may be equal to the main body diameter.

The electrical component within the device may comprise a printed circuit board (PCB). The lower socket plate face may be in abutment with the PCB. More specifically, the lower socket plate face may be in abutment with an upper face of the PCB. The lower socket plate face may comprise a central recessed portion such that a cavity is defined between the central recessed portion and the PCB. In other words the central recessed portion is longitudinally spaced from the PCB. In embodiments where the lower socket plate face comprises a recessed portion, a perimetral portion of the lower socket plate face is in abutment with the PCB.

The PCB may comprise at least one connection pad. The connection pad may be located within the cavity formed by the PCB and the recessed portion. The connection pad may be circular. The connection pad may have a pad diameter which is larger than a diameter of the second head. The socket plate bore and the connection pad may be axially aligned i.e. a centre point of the connection pad may be a point on a line collinear with an axis of the bore. The connection pad may be in electrical connection with an electrical component within the device. The connection pad may be in electrical connection with a terminal of the power source. For example, the connection pad may be in electrical connection with the positive terminal of the power source. Alternatively, the connection pad may be in electrical connection with the negative terminal of the power source.

The second head end face of the second head may be in abutment with the connection pad such that it is in electrical connection with the connection pad. In other words, the second head of the connector pin is in electrical connection with an electrical component within the device (e.g. the power source) via the corresponding connection pad. The second head may be in its retracted position. The connector pin may be axially aligned with the connection pad i.e. the centre point of the connection pad may be a point on a line collinear with the longitudinal axis of the connector pin.

The constraining feature of the connector pin may be in abutment with the central recessed portion of the lower socket plate face. In embodiments where the constraining feature is a flange, the first flange face of the connector pin may be in abutment with the central recessed portion of the lower socket plate face. Accordingly, the connector pin is longitudinally constrained. The outer face of the rib of the connector pin may be in abutment with an inner surface of the bore. In some embodiments, the bore diameter may be smaller than the rib diameter. This may help to constrain the connector pin in the bore.

The aerosol delivery device may comprise a plurality of connector pins, each extending within a respective one of the at least one socket plate bore. Each of the plurality of connector pins may connect to a respective one of the at least one connection pad.

The aerosol delivery device may comprise a first connector pin (as any embodiment described above) and a second connector pin (as any embodiment described above) laterally spaced from the first connector pin. The first connecter pin may act as a positive terminal and the second connector pin may act as a negative terminal. In other words, the first connector pin is in electrical connection with the positive terminal of the power source via a first connection pad and the second connector pin is in electrical connection with the negative terminal of the power source via a second connection pad. Alternatively, the first connector pin may act as a negative terminal and the second connector pin may act as a positive terminal. In other words, the first connector pin is in electrical connection with the negative terminal of the power source via the first connection pad and the second connector pin is in electrical connection with the positive terminal of the power source via the second connection pad.

The socket plate may comprise a socket plate groove on a transverse side. The socket plate groove may extend around the exterior of the socket plate. For example, the socket plate groove may extend around the entire perimeter of the socket plate.

The aerosol delivery device may comprise a retention clip. The retention clip may be configured to resist the expansion of the/each biasing element in the second head of the/each connector pin. In other words, the retention clip may prevent the second head of the/each connector pin moving from its retracted position to its extended position. A portion of the retention clip may be received in the socket plate groove.

The retention clip may comprise a retention plate which abuts a lower face of the PCB. The retention plate may have substantially the same transverse cross-sectional area as the PCB. The retention clip may further comprise a plurality of resilient members extending longitudinally from the retention plate. The plurality of resilient members may be spaced around an outer edge of the retention plate. The plurality of resilient members may be spaced around the outer edge of the retention plate at regular intervals. The resilient members may extend from the outer edge of the retention plate.

Each resilient member may comprise a protrusion which may extend towards the centre of the device body. The protrusion of each resilient member may extend into the socket plate groove. In other words, the protrusion of each resilient member may be received in the socket plate groove. The protrusion of each resilient member may be fixed in the socket plate groove using a snap-fit connection.

Consequently, the retention clip may retain the socket plate to the PCB. Further, the retention clip may resist the expansion of the/each biasing element in the second head of each connector pin.

The device comprises the power source which may be a battery. The power source may be a capacitor. The power source may be a rechargeable power source. The device may comprise a charging connection for connection to an external power supply for recharging of the power source within the device.

The front and/or rear surface of the device body may include at least one visual user feedback element, for example one or more lights e.g. one or more LEDs.

In some embodiments, the device body may include an illumination region configured to allow light provided by the visual user feedback element (e.g. one or more lights/LEDs) within the device body to shine through.

The device may comprise a movement detection unit (e.g. an accelerometer) for detecting a movement of the device, and a haptic feedback generation unit (e.g. an electric motor and a weight mounted eccentrically on a shaft of the electric motor).

The device may include a controller.

The controller may be configured to identify an operation of the device; and control the one or more lights contained within the device body, (e.g. to illuminate the illumination region) based on the operation of the device identified.

The controller may be configured to control the haptic feedback generation unit to generate the haptic feedback in response to the detection of movement of the device by the movement detection unit.

A memory may be provided and may be operatively connected to the controller. The memory may include non-volatile memory. The memory may include instructions which, when implemented, cause the controller to perform certain tasks or steps of a method.

Unless stated otherwise, all features described below are applicable to both the first and second aspects.

The device may comprise a wireless interface, which may be configured to communicate wirelessly with another device, for example a mobile device, e.g. via Bluetooth®. To this end, the wireless interface could include a Bluetooth® antenna. Other wireless communication interfaces, e.g. WiFi®, are also possible. The wireless interface may also be configured to communicate wirelessly with a remote server.

The device may comprise an airflow (i.e. puff) sensor that is configured to detect a puff (i.e. inhalation from a user). The airflow sensor may be operatively connected to the controller so as to be able to provide a signal to the controller that is indicative of a puff state (i.e. puffing or not puffing). The airflow sensor may, for example, be in the form of a pressure sensor or an acoustic sensor.

The controller may control power supply to a vaporizer/heating element in response to airflow detection by the sensor. The control may be in the form of activation of the vaporizer/heating element in response to a detected airflow.

The device of the first aspect may comprise an electrical connection (e.g. one or more contact pins) for connection of the power source to the vaporizer/heating element.

The device may comprise a chassis within the device body and one or more of the electrical components of the device (e.g. one or more of the power source, charging connection, visual feedback element, movement detection unit, haptic feedback generation unit, controller, memory, wireless interface, puff sensor and/or electrical connection) may be mounted on or affixed to the chassis.

The device may comprise a device body for housing the power source and/or other electrical components (e.g. at least one connector pin). The device body may be an elongate body i.e. with a greater length than depth/width. It may have a greater width than depth.

The device body may have a length of between 5 and 30 cm e.g. between 10 and 20 cm such as between 10 and 13 cm. The maximum depth of the device body may be between 5 and 30 mm e.g. between 10 and 20 mm.

The device body may have a front surface that is curved in the transverse dimension. The device body may have a rear surface that is curved in the transverse dimension. The curvatures of the front surface and rear surface may be of the opposite sense to one another. Both front and rear surfaces may be convex in the transverse dimension. They may have an equal radius of curvature.

The radius of curvature of the front surface may be between 10 and 50 mm, preferably between 10 and 40 mm, preferably between 10 and 30 mm, preferably been 10 and 20 mm, more preferably between 10 and 15 mm, more preferably substantially 13.5 mm.

The front and rear surfaces may meet at opposing transverse edges of the device body. This leads to a mandorla-/lemon-/eye-shaped cross sectional shape of the device body.

The transverse edges may have a radius of curvature that is significantly smaller than the radius of curvature of either the front or rear surface. This leads to the transverse edges being substantially "pointed" or "sharp". The transverse edges may have a radius of curvature in the transverse dimension of less than 10 mm, preferably less than 5 mm, preferably less than 2 mm, preferably less than 1 mm.

The transverse edges may extend substantially the full longitudinal length of the device body. However, in some embodiments, the transverse edges may only extend along a longitudinal portion of the device body.

The device body may have a curved longitudinal axis i.e. curved in a direction between the front and rear faces.

In a third aspect, there is provided an aerosol delivery system comprising a device according to the first or second aspects and a component for containing an aerosol precursor.

The component may be an aerosol-delivery (e.g. a smoking substitute) consumable i.e. in some embodiments the component may be a consumable component for engagement with the aerosol-delivery (e.g. a smoking substitute) device to form the aerosol-delivery (e.g. s smoking substitute) system.

The device may be configured to receive the consumable component. The device and the consumable component may be configured to be physically coupled together. For example, the consumable component may be at least partially received in a recess of the device, such that there is snap engagement between the device and the consumable component. Alternatively, the device and the consumable component may be physically coupled together by screwing one onto the other, or through a bayonet fitting.

Thus, the consumable component may comprise one or more engagement portions for engaging with the device.

The consumable component may comprise a vaporizer. The vaporizer may comprise a heating element. Alternatively, the vaporizer may comprise an ultrasonic or flow expansion unit, or an induction heating system.

The consumable component may comprise an electrical interface for interfacing with a corresponding electrical interface of the device (which comprises at least one connector pin for at least the second aspect as described above). The or both of the electrical interfaces may include one or more electrical contacts (which may extend through the transverse plate of the lower portion of the insert). Thus, when the device is engaged with the consumable component, the electrical interface may be configured to transfer electrical power from the power source to the vaporizer (e.g. heating element) of the consumable component. The electrical interface may also be used to identify the consumable component from a list of known types. The electrical interface may additionally or alternatively be used to identify when the consumable component is connected to the device.

The device may alternatively or additionally be able to detect information about the consumable component via an RFID reader, a barcode or QR code reader. This interface may be able to identify a characteristic (e.g. a type) of the consumable. In this respect, the consumable component may include any one or more of an RFID chip, a barcode or QR code, or memory within which is an identifier and which can be interrogated via the interface.

In other embodiments, the component may be integrally formed with the aerosol-delivery (e.g. a smoking substitute) device to form the aerosol-delivery (e.g. s smoking substitute) system.

In such embodiments, the aerosol former (e.g. e-liquid) may be replenished by re-filling a tank that is integral with the device (rather than replacing the consumable). Access to the tank (for re-filling of the e-liquid) may be provided via e.g. an opening to the tank that is sealable with a closure (e.g. a cap).

The smoking substitute system may comprise an airflow path therethrough, the airflow path extending from an air inlet to an outlet. The air inlet may be provided in the device body. The outlet may be at a mouthpiece portion of the component. In this respect, a user may draw fluid (e.g. air) into and along the airflow path by inhaling at the outlet (i.e. using the mouthpiece portion).

The airflow path passes the vaporizer between the air inlet and the outlet. The vaporizer may be provided in the component.

The airflow path may comprise a first portion extending from the air inlet towards the vaporizer. A second portion of the airflow path passes through the vaporizing chamber to a conduit that extends to the outlet. The conduit may extend along the axial centre of the component.

References to "downstream" in relation to the airflow path are intended to refer to the direction towards the outlet/mouthpiece portion. Thus the second portion of the airflow path is downstream of the first portion of the airflow path. Conversely, references to "upstream" are intended to refer to the direction towards the air inlet. Thus the first portion of the airflow path (and the air inlet) is upstream of the second portion of the airflow path (and the outlet/mouthpiece portion).

References to "upper", "lower", "above" or "below" are intended to refer to the component when in an upright/vertical orientation i.e. with elongate (longitudinal/length) axis of the component vertically aligned and with the mouthpiece vertically uppermost.

The component may comprise a tank for housing the aerosol precursor (e.g. a liquid aerosol precursor). The aerosol precursor may comprise an e-liquid, for example, comprising a base liquid and e.g. nicotine. The base liquid may include propylene glycol and/or vegetable glycerine.

At least a portion of one of the walls defining the tank may be translucent or transparent.

The conduit may extend through the tank with the conduit walls defining an inner region of the tank. In this respect, the tank may surround the conduit e.g. the tank may be annular.

As discussed above, the air flow path passes the vaporizer between the air inlet and the outlet. The vaporizer may comprise a wick e.g. an elongate wick which may have a cylindrical shape.

The wick may be oriented so as to extend in the direction of the width dimension of the component (perpendicular to the longitudinal axis of the component). Thus the wick may extend in a direction perpendicular to the direction of airflow in the airflow path.

The vaporizer may be disposed in the vaporizing chamber. The vaporizing chamber may form part of the airflow path.

The wick may comprise a porous material. A portion of the wick may be exposed to airflow in the airflow path. The wick may also comprise one or more portions in contact with liquid aerosol precursor stored in the tank. For example, opposing ends of the wick may protrude into the tank and a central portion (between the ends) may extend across the airflow path so as to be exposed to airflow. Thus, fluid may be drawn (e.g. by capillary action) along the wick, from the tank to the exposed portion of the wick.

The heating element may be in the form of a filament wound about the wick (e.g. the filament may extend helically about the wick). The filament may be wound about the exposed portion of the wick. The heating element is electrically connected (or connectable) to the power source. Thus, in operation, the power source may supply electricity to (i.e. apply a voltage across) the heating element so as to heat the heating element. This may cause liquid stored in the wick (i.e. drawn from the tank) to be heated so as to form a vapour and become entrained in airflow along the airflow path. This vapour may subsequently cool to form an aerosol e.g. in the conduit.

In a fourth aspect there is provided a method of using the aerosol-delivery (e.g. smoking substitute) system according to the third aspect, the method comprising engaging the consumable component with an aerosol-delivery (e.g. smoking substitute) device (as described above) having a power source so as to electrically connect the power source to the consumable component (i.e. to the vaporizer of the consumable component).

In a fifth aspect, there is provided a method for assembling an aerosol delivery device according to the second aspect. The method comprises the steps of inserting the connector pin into a socket plate bore; placing the socket plate in abutment with the electrical component (e.g. power source or printed circuit board) having a connection pad; retaining the electrical component, the socket plate and the/each connector pin in place with a retention clip such that the/each connector pin is in electrical contact with the electrical component (e.g. in electrical contact with the connection pad.

Where there is a plurality e.g. two connector pins, the method may comprise the steps of inserting each of the (e.g. two) connector pins into a respective socket plate bore; placing the socket plate in abutment with the electrical component; retaining the electrical component, the socket plate and the (two) connector pins in place with a retention clip such that the connector pins are in electrical contact with the electrical component.

Where the electrical component is a PCB with connection pad(s), the method may further comprise the step of connecting the/each connection pad with the power source.

The invention includes the combination of the aspects and preferred features described except where such a combination is clearly impermissible or expressly avoided.

BRIEF DESCRIPTION OF THE DRAWINGS

So that further aspects and features thereof may be appreciated, embodiments will now be discussed in further detail with reference to the accompanying figures, in which.

DETAILED DESCRIPTION OF THE EMBODIMENTS

Aspects and embodiments will now be discussed with reference to the accompanying figures. Further aspects and embodiments will be apparent to those skilled in the art.

Figure 1A:
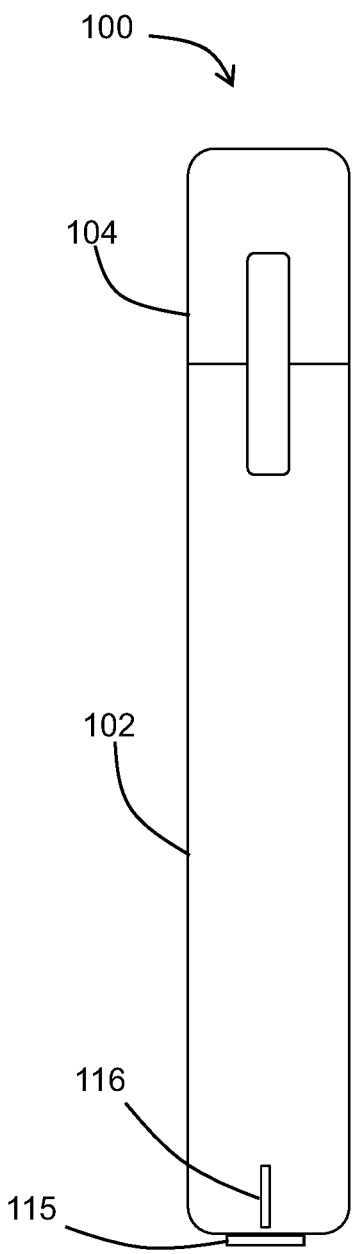
FIG. 1A is a front schematic view of a smoking substitute system.

FIG. 1A shows a first embodiment of a smoking substitute system 100. In this example, the smoking substitute system 100 includes a device 102 and a component 104. The component 104 may alternatively be referred to as a "pod", "cartridge" or "cartomizer". It should be appreciated that in other examples (i.e. open systems), the device may be integral with the component. In such systems, a tank of the aerosol delivery system may be accessible for refilling the device.

Figure 1B:
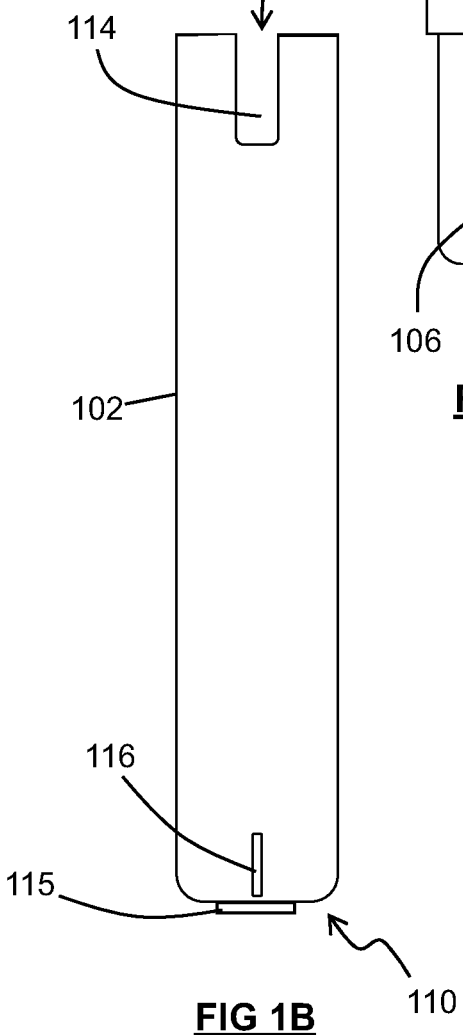
FIG. 1B is a front schematic view of a device of the system.
Figure 1C:
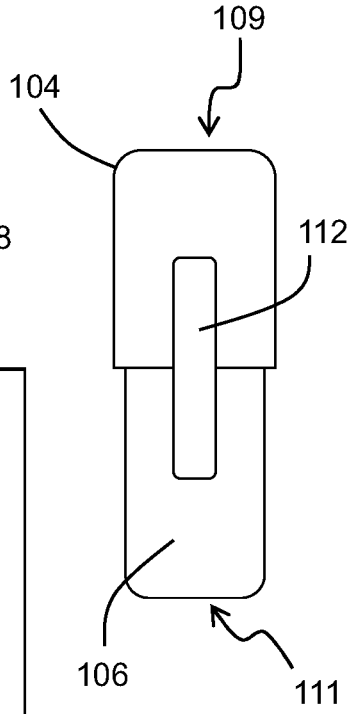
FIG. 1C is a front schematic view of a component of the system.

In this example, the smoking substitute system 100 is a closed system vaping system, wherein the component 104 includes a sealed tank 106 and is intended for single-use only. The component 104 is removably engageable with the device 102 (i.e. for removal and replacement). FIG. 1A shows the smoking substitute system 100 with the device 102 physically coupled to the component 104, FIG. 1B shows the device 102 of the smoking substitute system 100 without the component 104, and FIG. 1C shows the component 104 of the smoking substitute system 100 without the device 102.

The device 102 and the component 104 are configured to be physically coupled together by pushing the component 104 into a cavity at an upper end 108 of the device 102, such that there is an interference fit between the device 102 and the component 104. In other examples, the device 102 and the component may be coupled by screwing one onto the other, or through a bayonet fitting.

The component 104 includes a mouthpiece portion at an upper end 109 of the component 104, and one or more air inlets (not shown) in fluid communication with the mouthpiece portion such that air can be drawn into and through the component 104 when a user inhales through the mouthpiece portion. The tank 106 containing e-liquid is located at the lower end 111 of the component 104.

The tank 106 includes a window 112, which allows the amount of e-liquid in the tank 106 to be visually assessed. The device 102 includes a slot 114 so that the window 112 of the component 104 can be seen whilst the rest of the tank 106 is obscured from view when the component 104 is inserted into the cavity at the upper end 108 of the device 102. Whilst not shown, the component 104 may identify itself to the device 102, via an electrical interface, RFID chip, or barcode.

The device 102 includes a feedback element configured to provide feedback to the user relating to the operating condition of the device 102. In particular, the feedback element is a visual feedback element, configured to provide visual feedback based on the charge status of a power source of the device 102, as will be described in more detail below.

The visual feedback element comprises a source of light 116 arranged at the lower end 110 of the device 102. The source of light 116 is located behind a small translucent cover which defines an illumination region of the device 102. The light 116 is, in this example, one or more light emitting diodes (LED) which are operable in a combination of colours. The light 116 is configured to illuminate when the smoking substitute system 100 is activated. Additionally, or alternatively, the visual feedback element 116 may comprise a liquid crystal display (LCD) which may be arranged behind the translucent cover (or alternatively, may be present as an outermost surface of the main body).

In some examples, the device 102 has a mandorla-shaped cross-section, also referred to as an eye-shaped cross-section. The cross-section may have the shape resulting from the partial overlap of two circles having the substantially the same radii. In these examples, the light 116 is present on the larger surface of the main body, and components supporting the light 116 (wires etc. for the LEDs) may be positioned within the thinner void region of the interior surface (i.e. towards the lateral sides thereof).

The device 102 includes a movement detection unit configured to detect physical stimulus, in particular a movement of the device 102. The movement detection unit comprises one or more accelerometers which are configured to detect and measure the movement of the device 102. Alternatively, or in addition, the movement detection unit may comprise one or more tilt switches and/or one or more g-sensors. In this way, the movement detection unit is arranged to sense a purposeful movement of the device 102 by the user.

The movement detection unit is configured to detect device movements which are indicative of the device 102 being picked up, tapped or moved, by a user. Such physical stimuli may be detectable even without direct contact between the user and the device 102. In some embodiments, the physical stimulus from the user may be a tap or shake of the device, a sequence of taps or shakes, or a movement of the device to a particular orientation or along a specified motion path.

The lower end 110 of the device 102 also includes a charging connection 115, which is usable to charge a battery within the device 102. The charging connection 115 can also be used to transfer data to and from the device, for example to update firmware thereon.

Figure 2A:
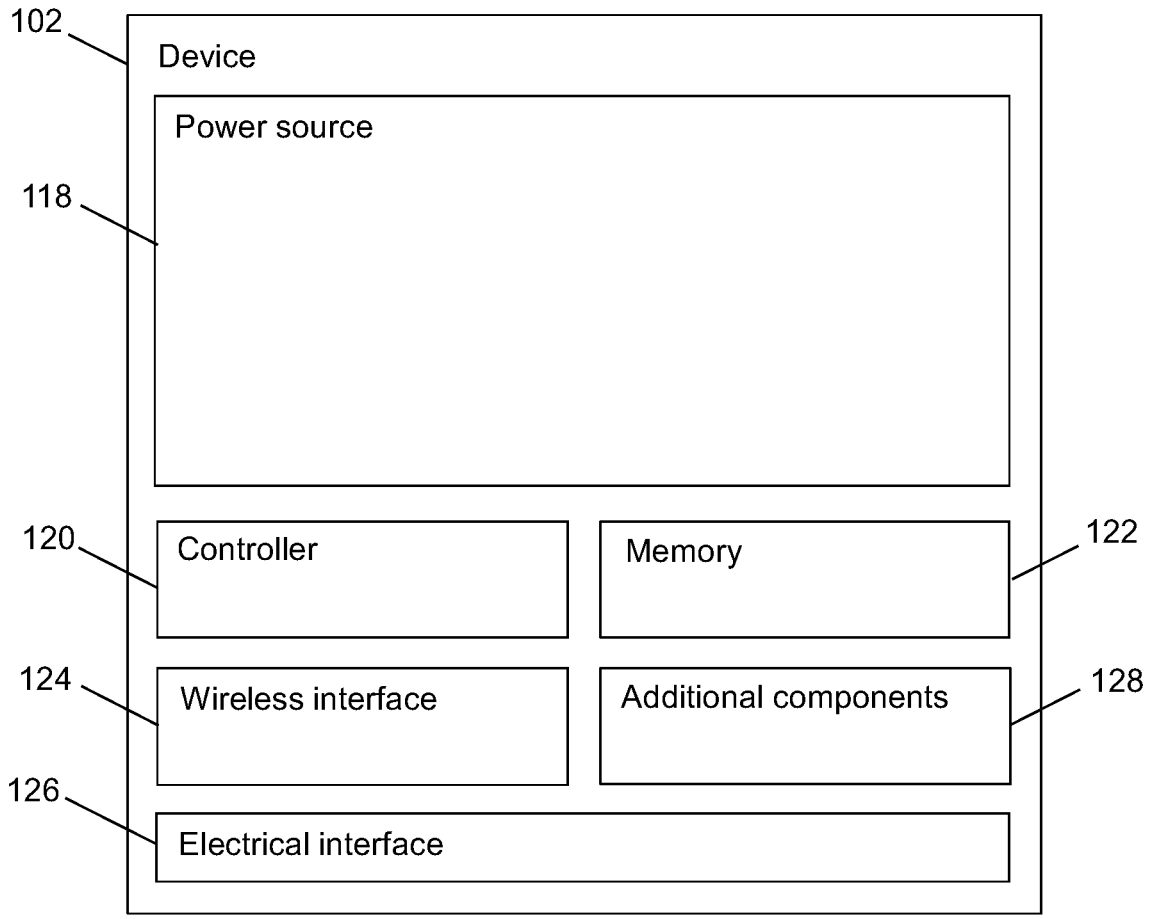
FIG. 2A is a schematic of the electrical components of the device.
Figure 2B:
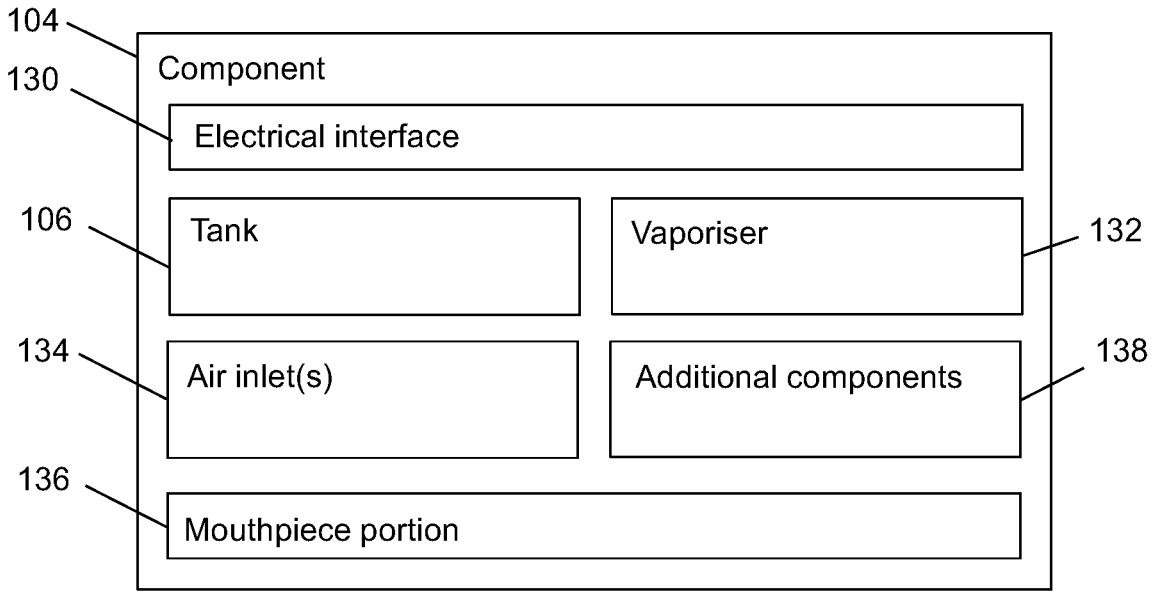
FIG. 2B is a schematic of the parts of the component.

FIGS. 2A and 2B are schematic drawings of the device 102 and component 104. As is apparent from FIG. 2A, the device 102 includes a power source 118, a controller 120, a memory 122, a wireless interface 124, an electrical interface 126, and, optionally, one or more additional components 128.

The power source 118 is preferably a battery, more preferably a rechargeable battery. The power source 118 is arranged to hold a level of charge, which defines a capacity to store electrical power. The power source 118 is provided with a charge determination unit which is configured to determine the level of charge of the power source 118, i.e. the battery level.

The controller 120 may include a microprocessor, for example. The memory 122 preferably includes non-volatile memory. The memory may include instructions which, when implemented, cause the controller 120 to perform certain tasks or steps of a method.

The wireless interface 124 is preferably configured to communicate wirelessly with another device, for example a mobile device, e.g. via Bluetooth®. To this end, the wireless interface 124 could include a Bluetooth® antenna. Other wireless communication interfaces, e.g. WiFi®, are also possible. The wireless interface 124 may also be configured to communicate wirelessly with a remote server.

The electrical interface 126 of the device 102 may include one or more electrical contacts e.g. one or more connector pins. The electrical interface 126 may be located in a base of the aperture in the upper end 108 of the device 102. When the device 102 is physically coupled to the component 104, the electrical interface 126 is configured to transfer electrical power from the power source 118 to the component 104 (i.e. upon activation of the smoking substitute system 100).

The electrical interface 126 may also be used to identify the component 104 from a list of known components. For example, the component 104 may be a particular flavour and/or have a certain concentration of nicotine (which may be identified by the electrical interface 126). This can be indicated to the controller 120 of the device 102 when the component 104 is connected to the device 102. Additionally, or alternatively, there may be a separate communication interface provided in the device 102 and a corresponding communication interface in the component 104 such that, when connected, the component 104 can identify itself to the device 102.

The additional components 128 of the device 102 comprise at least one feedback element configured to provide feedback to the user based on the current operating state of the device 102. The feedback element comprises a visual feedback element, such as the source of light 116 discussed above. The additional components 128 of the device 102 further comprise a movement detection unit configured to detect movement of the device 102, and a charge determination unit configured to determine the level of charge of the power source, as described above.

In operation, the feedback element is configured to provide feedback based on the charge level of the power source. In particular, the feedback element is controlled to provide the feedback in response to a movement of the device 102 being detected by the movement detection unit.

In this way, when the device 102 is picked up by the user (or tapped, or moved in any way), the feedback element will indicate useful information about the battery. Thus, the feedback element ensures that the battery level information, which is of key importance to the user, is easily and conveniently communicated during normal use of the device 102. The user is, therefore, able to check the battery level status of the device 102 without having to provide a specific input (such as pressing a button). Furthermore, by implementing the battery level status indication as part of a standard action of the user (i.e. picking device up), the task of checking the battery status can be encompassed in a simple subconscious act of the user.

Figure 3:
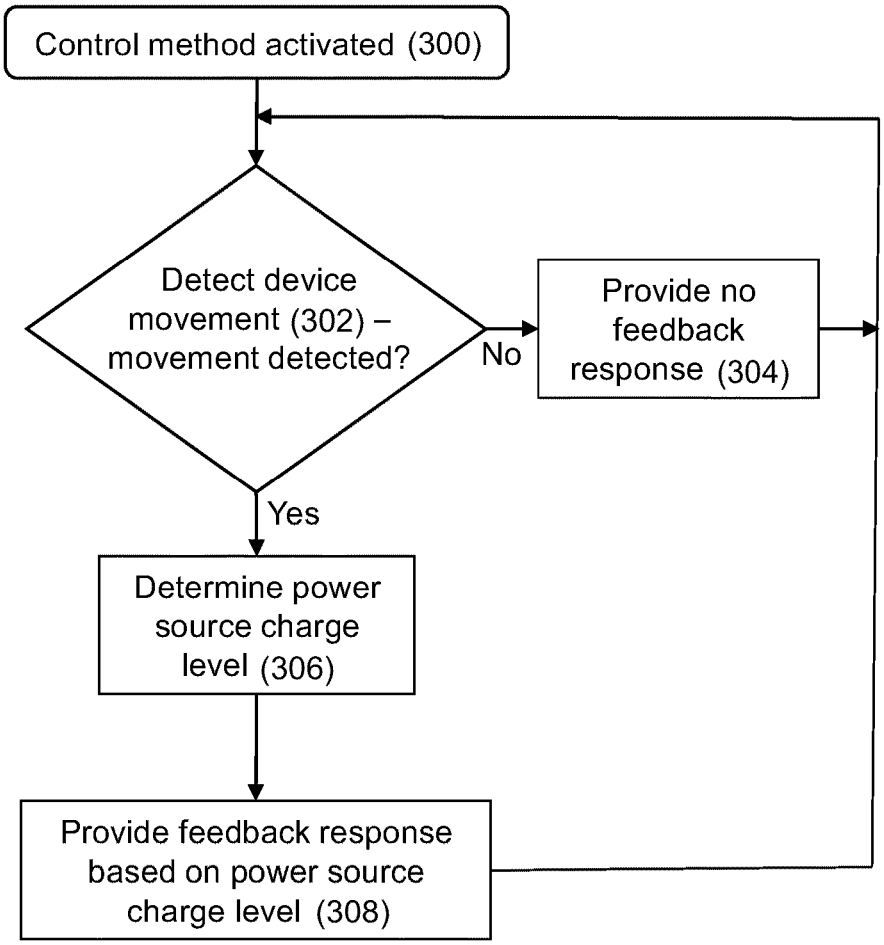
FIG. 3 is a flow chart of a method of operating the device.

An exemplary method of operating the device 102 will now be described with reference to FIG. 3, which illustrates a flow chart of the corresponding method steps. The method steps are stored as a set of executable instructions on the memory 122 of the device 102. The controller 120 is configured to implement the method in order to control the illumination of the light 116 in accordance with the method steps. In this way, the controller 120 defines a feedback controller of the feedback element.

The method commences with a first method step 300 in which the charge mode of the device 102 is activated by the user by connecting the device 102 up to an external power source. In a second method step 302, the movement detection unit senses for a movement of the device 102. If no movement is detected, then the method proceeds to a third method step 304 in which the feedback element is configured not to provide feedback (i.e. the light 116 is not activated). If a movement is detected, then the method proceeds to a fourth method step 306 in which the charge level determining unit determines the charge level of the battery. In a final method step 308, the feedback element is configured, in response to the detected movement of the device 102, to provide a feedback response based on the determined charge level of the battery.

According to the above described method, the feedback element is configured to only provide feedback when the device 102 is operating in a charging mode, i.e. when the battery is undergoing a charging operation. Alternative exemplary methods of operating the device 102 may be activated in dependence on additional and/or alternative stimuli, such as the device 102 being switched on by the user.

The movement detection unit can be calibrated to exclude unwanted vibrations which do not correspond to a deliberate movement of the device by the user. For example, the accelerometer may be configured to ignore vibrations which may be transmitted, for example, through a table on which the device 102 is resting. The calibration of the movement detection unit ensures that the feedback element is only activated at an appropriate time, thereby reducing unwanted distractions for the user. In this way, the calibration of the movement detection unit reduces extraneous illuminations of the light 116 which would otherwise drain power from the battery.

The movement detection unit is configured to measure a movement parameter, such as an external force that is exerted upon the device 102. The movement detection unit is configured to compare the measured movement parameter with a predetermined threshold value. The predetermined threshold value represents a movement parameter value which corresponds to a minimum level of device movement that would require activation of the feedback element. Thus, the movement detection unit is calibrated to avoid unwanted activation of the feedback element, in order to ignore physical stimuli below a predetermined level.

In an exemplary arrangement of the device 102, the device is operated in a charging mode. In particular, the feedback element is configured such that it doesn't provide feedback when the device 102 is charging and when no device movement is detected. To achieve this, the feedback element is configured to identify that the device 102 is undergoing a charging operation (e.g. the power source is receiving and storing power) and, in response to a detected device movement, provide feedback based on the charge status of the power source. The controller 120 receives a charge status signal from the charge determination unit indicating that the power source is being charged.

The charge status signal is indicative of an increase in the charge level of the battery. Upon determining that the battery is being charged, the controller 120 then waits to receive a movement signal indicative of device undergoing a movement event (e.g. through activation of the accelerometer). Upon determining that the device has been moved, the feedback element controls the light 116 to illuminate so as to indicate to the user that the device 102 is undergoing a charging operation. In this way, the light 116 is prohibited from illuminating when the battery is charging and when no device movement is detected.

In this way, the light 116 is set to an off configuration when the device 102 is being charged so as to prevent the light from emitting an unwanted illumination which could prove distracting to the user. It is common for a user to charge their device at night, whereupon the device 102 may be placed near to the user (e.g. on a bedside table). By controlling the light 116 to only illuminate when a device movement is detected, the feedback element is configured to ensure that the light 116 does not disturb or distract the user when they are trying to sleep. If the user wishes to check whether the device is charging, they may pick-up the device 102. At which point, the detected movement of the device 102 will cause the feedback element to provide visual feedback to the user, informing them that the device 102 is being charged.

The feedback element is configured to provide feedback to the user for a predetermined period of time before turning off the illumination. In particular, the feedback controller controls the light 116 to turn off the illumination after three seconds. The predetermined period of illumination is calibrated so that the user, having identified that the device is charging, can return to sleep quickly without being disturbed by continued illumination from the device 102. Turning off the light 116 after a short illumination period also increases the user's perception that the device is not using battery power on extraneous functionalities, which is important to a user of such devices.

As well as notifying the user that the device is being charged, the feedback element can also be controlled to provide information relating to the current charge status of the battery. A detected movement of the device 102 will cause the light 116 to produce one of a list of selectable feedback responses to the user (i.e. different illuminations) in order to indicate the different charge states of the battery. For example, the light 116 may be controlled to produce illuminations having different colours, and/or intensities and/or durations, in order to indicate a change in the battery level.

The different illuminations are achieved by varying the output from the illuminated area of the device 102. In particular, the controller 120 is configured to control the illumination intensity of each LED and/or the activation of a plurality of LEDs, based on the determined charge status of the battery. Each of the different illuminations are selectable from a plurality of illuminations which are stored in the memory 122 of the controller 120.

During use, the feedback controller receives a charge status signal from the charge determination unit, indicating the current charge status of the battery. If the charge level of the battery is above a first predetermined charge threshold value, then the light 116 is controlled to produce a first illumination. If the battery level is below the threshold value then a second illumination is provided. The light 116 is controlled so that each of the first and second illuminations comprise different colours and/or have different illumination intensities. Each of the first and second illuminations may also comprise pulsed illuminations having different frequencies.

According to an exemplary arrangement of the device 102, when the battery level is 100%, the light 116 is controlled to provide a third illumination comprising a solid, or continuous, green illumination. If the battery level is between 50% and 99%, then the light 116 is configured to provide a first illumination comprising a pulsed green light. In situations where the battery level is between 20% and 50% the light 116 is configured to provide a second illumination comprising a pulsed yellow light. Finally, when the battery level is between 0% and 19%, then the light 116 is controlled to produce a fourth illumination comprising a pulsed red illumination. Each of the above described illuminations are canceled after three seconds of being initiated. In all of the above described exemplary operations of the device 102, the light 116 is controlled to only provide feedback in response to a detected movement of the device.

The feedback element is conveniently configured to output pulsed illuminations which increases the number and variety of the feedback responses that can be displayed to the user. For example, a single LED can be configured to pulse at different frequencies in order to provide variety of different feedback responses to the user. Accordingly, the provision of pulsed illuminations reduces the requirement to house different coloured LEDs within the device 102, which thereby lowers the cost and complexity of its manufacturer.

The additional components 128 of the device 102 also comprises the charging connection 115 configured to receive power from the charging station (i.e. when the power source 118 is a rechargeable battery). This may be located at the lower end 110 of the device 102.

The additional components 128 of the device 102 may, if the power source 118 is a rechargeable battery, include a battery charging control circuit, for controlling the charging of the rechargeable battery. However, a battery charging control circuit could equally be located in a charging station (if present).

The additional components 128 of the device 102 may include a sensor, such as an airflow (i.e. puff) sensor for detecting airflow in the smoking substitute system 100, e.g. caused by a user inhaling through a mouthpiece portion 136 of the component 104. The smoking substitute system 100 may be configured to be activated when airflow is detected by the airflow sensor. This sensor could alternatively be included in the component 104. The airflow sensor can be used to determine, for example, how heavily a user draws on the mouthpiece or how many times a user draws on the mouthpiece in a particular time period.

The additional components 128 of the device 102 may include a user input, e.g. a button. The smoking substitute system 100 may be configured to be activated when a user interacts with the user input (e.g. presses the button). This provides an alternative to the airflow sensor as a mechanism for activating the smoking substitute system 100.

As shown in FIG. 2B, the component 104 includes the tank 106, an electrical interface 130, a vaporizer 132, one or more air inlets 134, a mouthpiece portion 136, and one or more additional components 138.

The electrical interface 130 of the component 104 may include one or more electrical contacts. The electrical interface 126 of the device 102 and an electrical interface 130 of the component 104 are configured to contact each other and thereby electrically couple the device 102 to the component 104 when the lower end 111 of the component 104 is inserted into the upper end 108 of the device 102 (as shown in FIG. 1A). In this way, electrical energy (e.g. in the form of an electrical current) is able to be supplied from the power source 118 in the device 102 to the vaporizer 132 in the component 104.

The vaporizer 132 is configured to heat and vaporize e-liquid contained in the tank 106 using electrical energy supplied from the power source 118. As will be described further below, the vaporizer 132 includes a heating filament and a wick. The wick draws e-liquid from the tank 106 and the heating filament heats the e-liquid to vaporize the e-liquid.

The one or more air inlets 134 are preferably configured to allow air to be drawn into the smoking substitute system 100, when a user inhales through the mouthpiece portion 136. When the component 104 is physically coupled to the device 102, the air inlets 134 receive air, which flows to the air inlets 134 along a gap between the device 102 and the lower end 111 of the component 104.

In operation, a user activates the smoking substitute system 100, e.g. through interaction with a user input forming part of the device 102 or by inhaling through the mouthpiece portion 136 as described above. Upon activation, the controller 120 may supply electrical energy from the power source 118 to the vaporizer 132 (via electrical interfaces 126, 130), which may cause the vaporizer 132 to heat e-liquid drawn from the tank 106 to produce a vapour which is inhaled by a user through the mouthpiece portion 136.

An example of one of the one or more additional components 138 of the component 104 is an interface for obtaining an identifier of the component 104. As discussed above, this interface may be, for example, an RFID reader, a barcode, a QR code reader, or an electronic interface which is able to identify the component. The component 104 may, therefore include any one or more of an RFID chip, a barcode or QR code, or memory within which is an identifier and which can be interrogated via the electronic interface in the device 102.

It should be appreciated that the smoking substitute system 100 shown in FIGS. 1A to 2B is just one exemplary implementation of a smoking substitute system. For example, the system could otherwise be in the form of an entirely disposable (single-use) system or an open system in which the tank is refillable (rather than replaceable).

Figure 4:
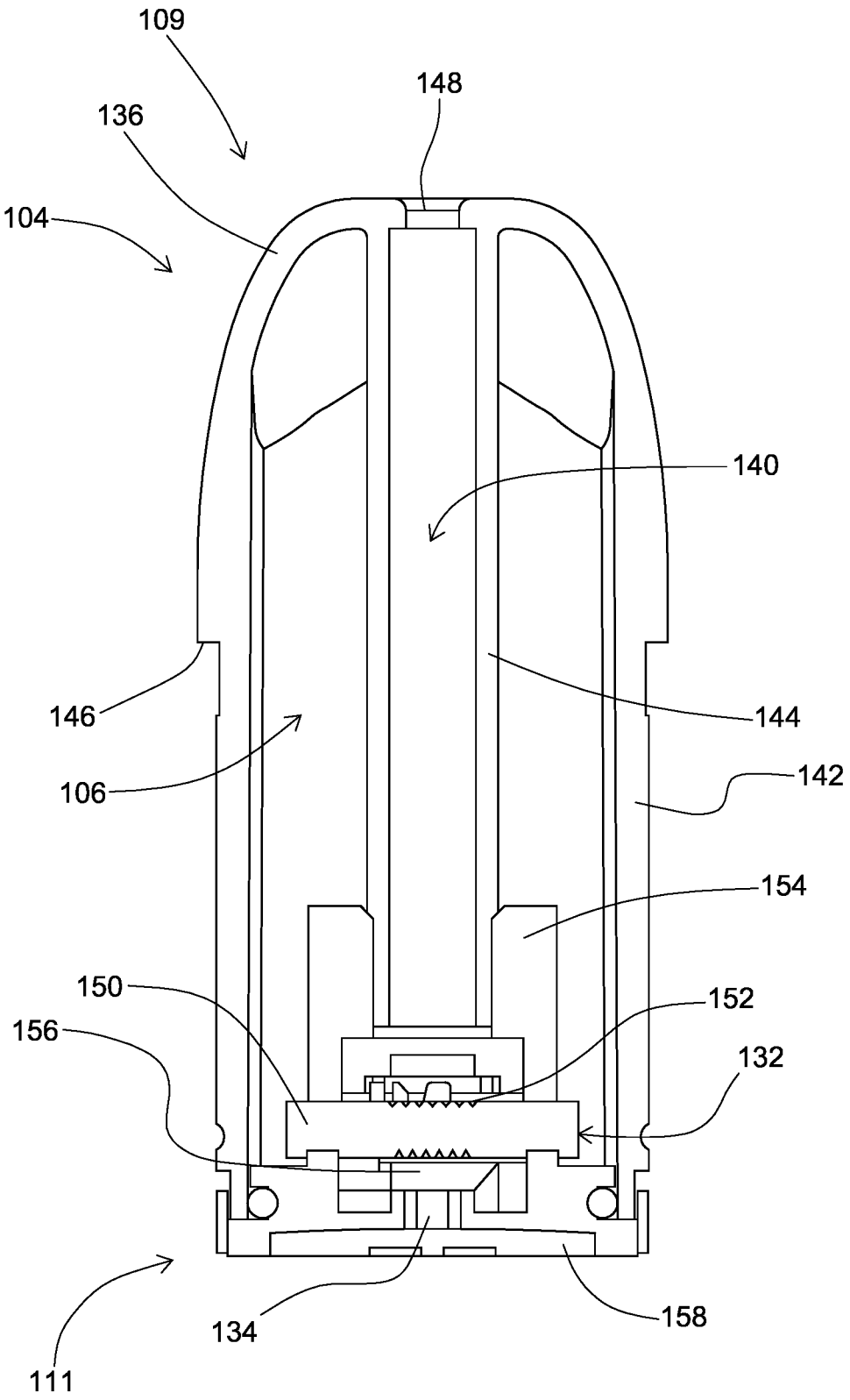
FIG. 4 is a section view of the component.

FIG. 4 is a section view of an example of the component 104 described above. The component 104 comprises a tank 106 for storing e-liquid, a mouthpiece portion 136 and a conduit 140 extending along a longitudinal axis of the component 104. In the illustrated embodiment the conduit 140 is in the form of a tube having a substantially circular transverse cross-section (i.e. transverse to the longitudinal axis). The tank 106 surrounds the conduit 140, such that the conduit 140 extends centrally through the tank 106.

A tank housing 142 of the tank 106 defines an outer casing of the component 104, whilst a conduit wall 144 defines the conduit 140. The tank housing 142 extends from the lower end 111 of the component 104 to the mouthpiece portion 136 at the upper end 109 of the component 104. At the junction between the mouthpiece portion 136 and the tank housing 142, the mouthpiece portion 136 is wider than the tank housing 142, so as to define a lip 146 that overhangs the tank housing 142. This lip 146 acts as a stop feature when the component 104 is inserted into the device 102 (i.e. by contact with an upper edge of the device 102).

The tank 106, the conduit 140 and the mouthpiece portion 136 are integrally formed with each other so as to form a single unitary component and may e.g. be formed by way of an injection moulding process. Such a component may be formed of a thermoplastic material such as polypropylene.

The mouthpiece portion 136 comprises a mouthpiece aperture 148 defining an outlet of the conduit 140. The vaporizer 132 is fluidly connected to the mouthpiece aperture 148 and is located in a vaporizing chamber 156 of the component 104. The vaporizing chamber 156 is downstream of the inlet 134 of the component 104 and is fluidly connected to the mouthpiece aperture 148 (i.e. outlet) by the conduit 140.

The vaporizer 132 comprises a porous wick 150 and a heater filament 152 coiled around the porous wick 150. The wick 150 extends transversely across the chamber vaporizing 156 between sidewalls of the chamber 156 which form part of an inner sleeve 154 of an insert 158 that defines the lower end 111 of the component 104 that connects with the device 102. The insert 158 is inserted into an open lower end of the tank 106 so as to seal against the tank housing 142.

In this way, the inner sleeve 154 projects into the tank 106 and seals with the conduit 140 (around the conduit wall 144) so as to separate the vaporizing chamber 156 from the e-liquid in the tank 106. Ends of the wick 150 project through apertures in the inner sleeve 154 and into the tank 106 so as to be in contact with the e-liquid in the tank 106. In this way, e-liquid is transported along the wick 150 (e.g. by capillary action) to a central portion of the wick 150 that is exposed to airflow through the vaporizing chamber 156. The transported e-liquid is heated by the heater filament 152 (when activated e.g. by detection of inhalation), which causes the e-liquid to be vaporized and to be entrained in air flowing past the wick 150. This vaporized liquid may cool to form an aerosol in the conduit 140, which may then be inhaled by a user.

Figure 5:
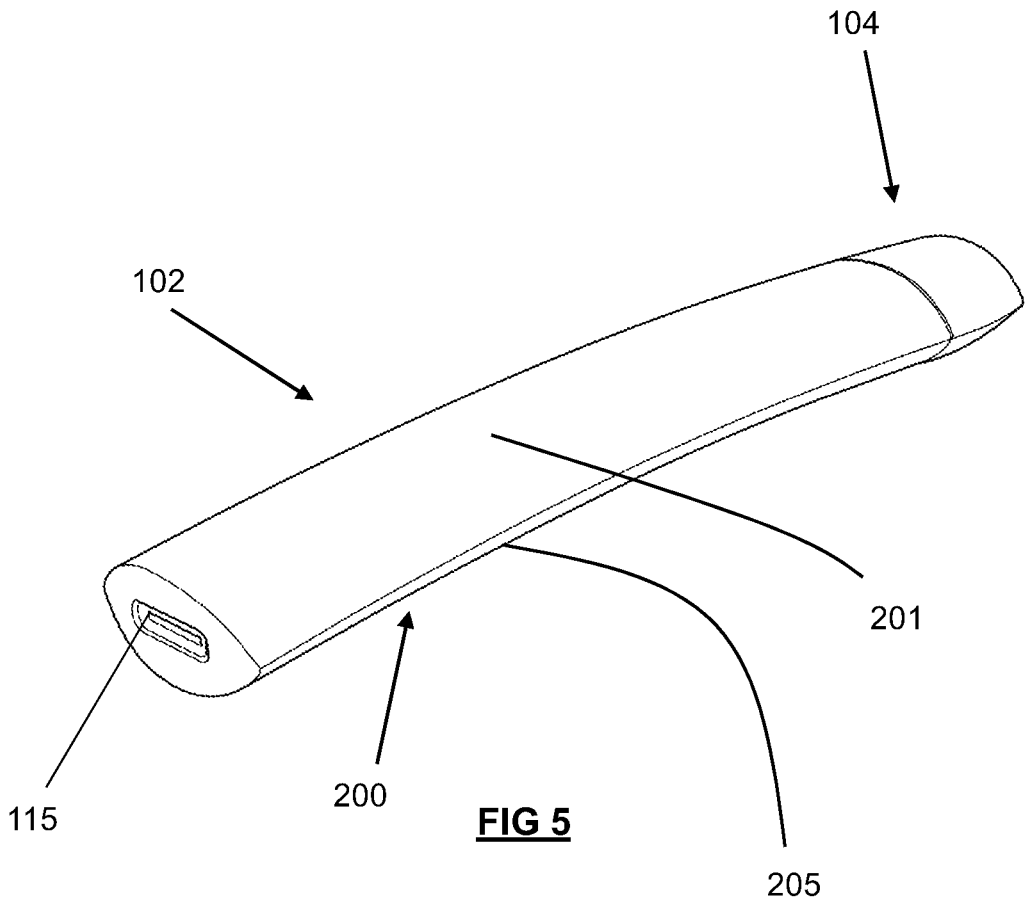
FIG. 5 is a perspective view of an embodiment of the second aspect the device.

FIG. 5 shows a perspective view of an embodiment of the device 102 engaged with the component 104 at the upper end 108. The device 102 includes a charging connection 115 at the lower end 110.

The front surface 201 of the device body 200 is curved in the transverse dimension. The rear surface 202 of the device body 200 is curved in the transverse dimension. The curvatures of the front surface 201 and rear surface 202 are of the opposite sense to one another. Both front and rear surfaces 201, 202 are convex in the transverse dimension. This leads to a mandorla-/lemon-/eye-shaped cross sectional shape of the device body 200.

The front surface 201 and rear surface 202 meet at two transverse edges 205. The transverse edges 205 have a radius of curvature that is significantly smaller than the radius of curvature of either the front 201 or rear surface 202. This leads to the transverse edges being substantially "pointed" or "sharp". The transverse edges may have a radius of curvature in the transverse dimension of less than 1 millimetre.

As illustrated in FIG. 5, the transverse edges 205 extend substantially the full longitudinal length of the device body 200.

The front surface 201 of the device body 200 may include an illumination region through which at least one light source may be visible.

Figure 6:
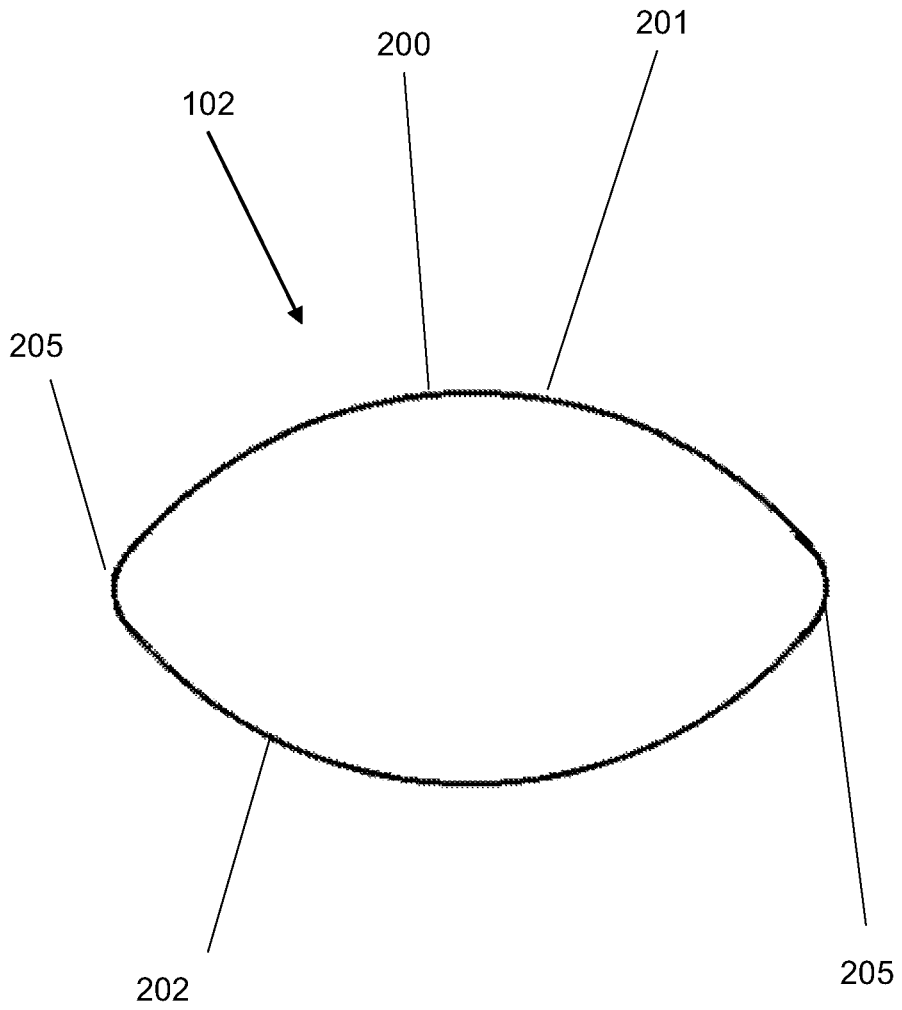
FIG. 6 is a schematic transverse cross-section view of the device body of FIG. 5.

FIG. 6 illustrates a schematic transverse cross section through the device 102 of FIG. 5, in accordance with an embodiment. The front surface 201 and rear surface 202 are shown meeting at the transverse edges 205 on either side of the device body 200. The radius of curvature in the transverse dimension of the front surface 201 is equal to the radius of curvature in the transverse dimension of the rear surface 202.

The radius of curvature of the front surface 201 may be between 10 and 15 mm.

The electrical interface 126 of the device 102 comprises a plurality of connector pins 20*a*, 20*b* which are assembled in the upper end 108 of the device 102.

Figure 7:
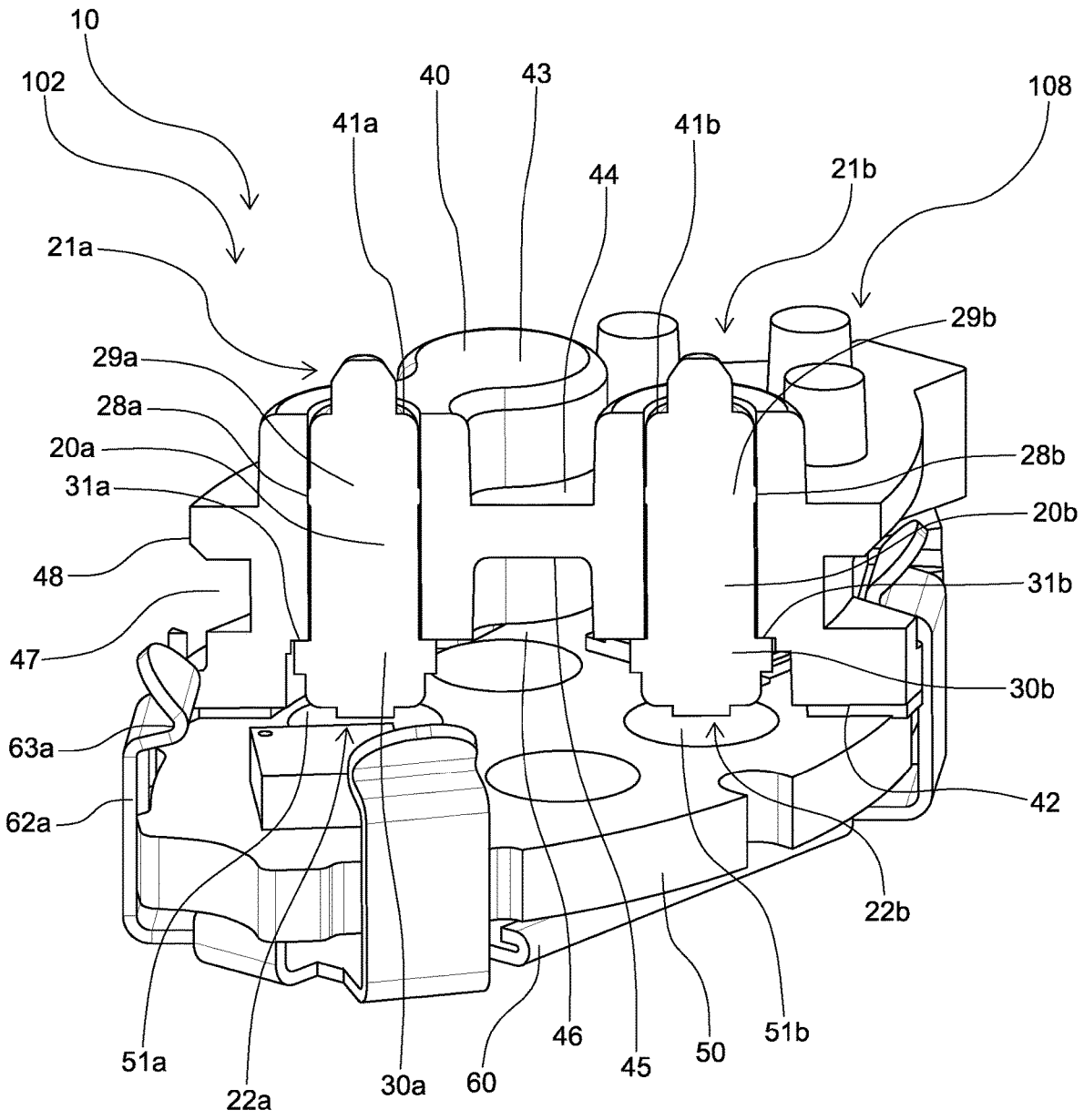
FIG. 7 is a partial cutaway perspective view of a portion of the aerosol delivery device of the second aspect.

FIG. 7 shows a portion 10 at the upper end 108 of the device 102 which comprises connector pins 20*a*, 20*b*, each having a first head 21*a*, 21*b* for electrical connection to the component 104 and a second head 22*a*, 22*b* for electrical connection to an electrical component (e.g. the power source 118) within the device 102. Both the first heads 21*a*, 21*b* and the second heads 22*a*, 22*b* comprise first and second springs (not shown).

Figure 8:
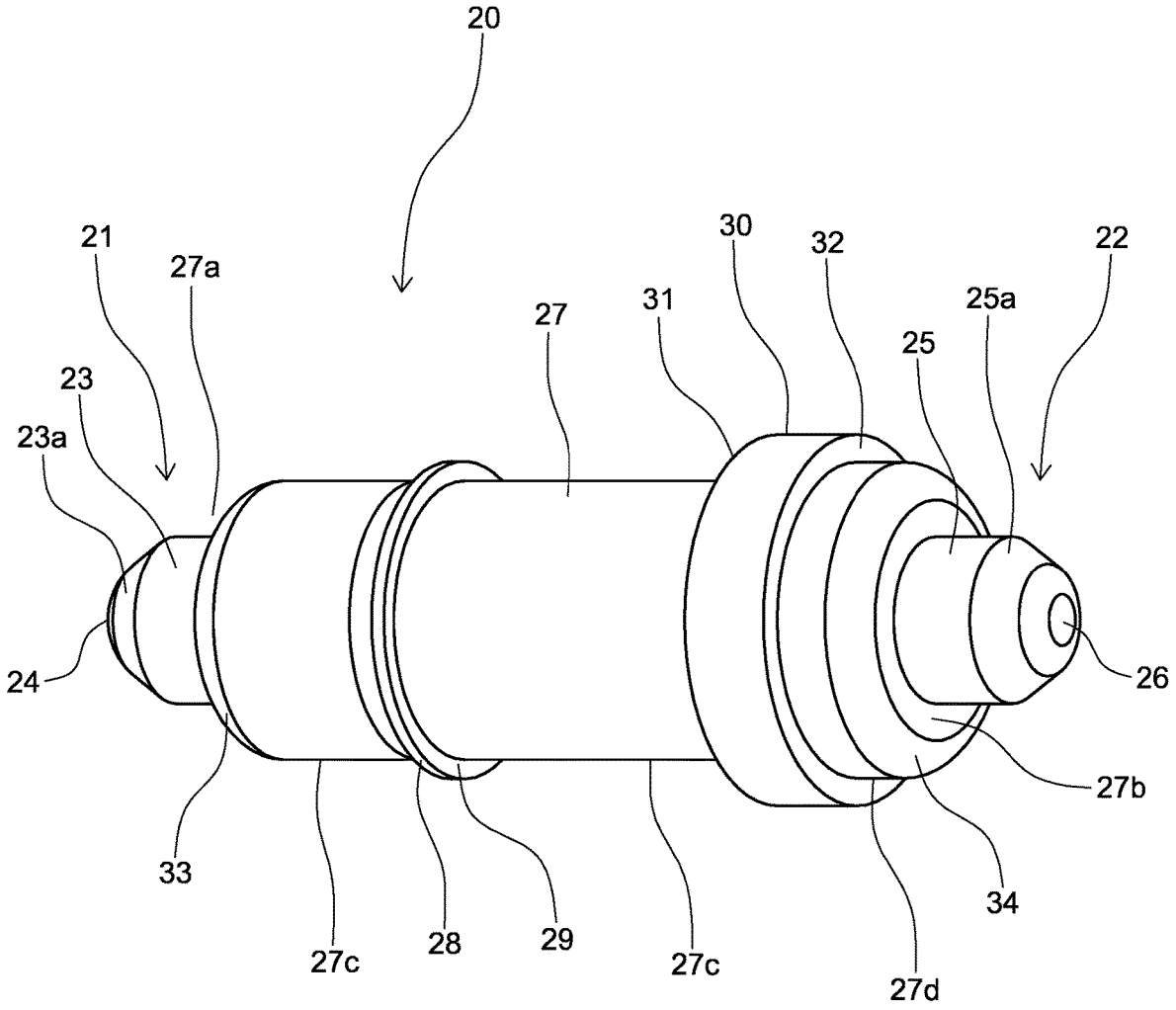
FIG. 8 is a perspective view of the connector pin.

FIG. 8 shows a connector pin 20 which is identical to the connector pins 20*a*, 20*b* shown in FIG. 7. The connector pin 20 has a main body 27 which is an elongate rod-like element with a circular transverse cross-sectional shape. It has a longitudinal axis extending along its length. The main body 27 extends from the first head 21 to the second head 22 along the longitudinal axis. The first head 21 and the second head 22 are at opposite longitudinal ends of the main body 27. The first head 21 of the connector pin 20 comprises a cylindrical portion 23 and a first longitudinal head end face 24. The second head 22 of the connector pin 20 comprises a cylindrical portion 25 and a second longitudinal head end face 26. The first head end face 24 is substantially parallel to the second head end face 26 and is substantially perpendicular to the longitudinal axis. There is an angled portion 23*a* extending between the first head cylindrical portion 23 and the first head end face 24. There is an angled portion 25*a* extending between the second head cylindrical portion 25 and the second head end face 26.

The main body 27 has a main body diameter and is at least partly hollow. The main body 27 has a first longitudinal body end face 27*a* proximate the first head 21 and has a second longitudinal body end face 27*b* proximate the second head 22. The first body end face 27*a* and the second body end face 27*b* are substantially parallel to the first and second head end faces 24, 26. The first body end face 27*a* comprises a circumferential first fillet 33 and the second body end face 27*b* comprises a second circumferential fillet 34.

The first head 21 extends through a first body aperture (not shown) in the first body end face 27*a* and away from the main body 27. In other words, the first head end face 24 is longitudinally spaced from the first body end face 27*a*. The second head 22 extends through a second body aperture (not shown) in the second body end face 27*b* and away from the main body 27. In other words, the second head end face 26 is longitudinally spaced from the second body end face 27*b*. The first head 21 and the second head 22 are axially aligned with the main body 27 (i.e. longitudinally extending axes of the first head 21 and the second head 22 are collinear with the longitudinal axis of the main body 27). The first and second heads 21, 22 have circular transverse cross-sectional areas.

The first head 21 is resiliently biased towards an extended position (shown in FIG. 7) and is movable against the bias to a retracted position (shown in FIG. 6). In the extended position, the first head end face 24 and the first body end face 27*a* are longitudinally spaced further apart than in the first retracted position. More specifically, the first head end face 24 and the first body end face 27*a* are spaced at the maximum distance apart.

The second head 22 is resiliently biased towards an extended position (shown in FIG. 7) and is movable against the bias to a retracted position (shown in FIG. 6). In the extended position, the second head end face 26 and the second body end face 27*b* are longitudinally spaced further apart than in the first retracted position. More specifically, the second head end face 26 and the second body end face 27*b* are spaced at the maximum distance apart.

The first head 21 comprises a first spring (not shown) such that it is resiliently biased towards an extended position. The second head 22 comprises a second spring (not shown) such that it is resiliently biased towards an extended position. The first and second heads 21, 22 are hollow such that the first and second springs are respectively located at least partly inside the first and second heads 21, 22. The first and second springs are also at least partially inside the main body 27.

The connector pin 20 comprises a radially protruding flange 30 on the main body 27. This allows the connector pin 20 to be constrained in the device 102 (i.e. prevents axial movement of the connector pin 20 within the device 102). The flange 30 fully extends around the exterior of the main body 27. In other words, the flange 30 is a circumferential flange. The flange 30 is proximate the second head end face 26 of the connector pin 20 and has a flange thickness along the longitudinal axis of the connector pin 20. The flange 30 has a flange diameter.

The flange 30 has a first flange face 31 which faces away from the second head 22 and towards the first head 21 of the connector pin 20 and a second flange face 32 which faces away from the first head 21 towards the second head 22 of the connector pin 20. The first and second flange faces 31, 32 are substantially parallel and approximately perpendicular to the longitudinal axis of the connector pin 20.

The connector pin 20 comprises a radially protruding rib 29 which fully extends around the exterior of the main body 27. In other words, the main body 27 has a circumferential rib 29. The rib 29 is more proximate the first head 21 than the flange 30 and has a rib diameter which is smaller than the flange diameter. The rib thickness (along the longitudinal axis of the connector pin 20) is smaller than the flange thickness. The rib 29 comprises an outer face 28 which faces radially outward.

The main body 27 has a stepped transverse cross-sectional area. The main body 27 has a first transverse cross-sectional area between the first head 21 and the flange 30 (indicated by numeral 27*c*) and a second cross-section area between the flange 30 and the second head 22 (indicated by numeral 27*d*). The second cross-section area 27*d* is larger than the first cross-section area 27*c*. The main body diameter referred to above is the diameter of the first cross-sectional area 27*c*.

Returning to FIG. 7, the device 102 also comprises a socket plate 40 at the upper end 108 which is configured to be removably engageable with the component 104. The socket plate 40 comprises two socket plate bores 41*a*, 41*b* which extend through the thickness of the socket plate 40 in a direction parallel with a longitudinal axis of the device 102. The socket plate 40 comprises a lower transverse socket plate face 42 which is in abutment with a printed circuit board (PCB) 50. The socket plate 40 also has an upper socket plate face 43 which comprises a plurality of recesses e.g. 44.

The connector pins 20*a*, 20*b* extend through respective socket plate bores 41*a*, 41*b* such that the first heads 21*a*, 21*b* extend above the upper socket plate face 43. The main body diameter is smaller than the diameter of the socket plate bores 41*a*, 41*b*.

The lower socket plate face 42 comprises a central recessed portion 45 such that a cavity 46 is defined between the central recessed portion 45 and the PCB 50.

The PCB 50 comprises two circular connection pads 51*a*, 51*b* which each correspond to one of the connector pins 20*a*, 20*b*. The diameter of the connection pads 51*a*, 51*b* is larger than the diameter of the diameter of the second heads 25*a*, 25*b*. The connection pads 51*a*, 51*b* are axially aligned with the socket plate bores 41*a*, 41*b* i.e. a centre point of each connection pad 51*a*, 51*b* is a point on a line collinear with an axis of the corresponding bore 41*a*, 41*b*. One of the connection pads 51*a* is in electrical connection with a positive terminal (not shown) of the power source 118 whilst the other connection pad 51*b* is in electrical connection with a negative terminal (not shown) of the power source 118. Consequently, the second head 22*a*, 22*b* of each connector pin 20*a*, 20*b* is in electrical connection with the power source 118 via the corresponding connection pad 51*a*, 51*b*. Each connector pin 20*a*, 20*b* is axially aligned with the corresponding connection pad 51*a*, 51*b* i.e. the centre point of each connection pad 51*a*, 51*b* is a point on a line collinear with the longitudinal axis of the corresponding connector pin 20*a*, 20*b*.

The first flange face 31*a*, 31*b* of each flange 30*a*, 30*b* is in abutment with the central recessed portion 45 of the socket plate 40. Accordingly, the connector pins 20*a*, 20*b* are constrained in a direction parallel with the longitudinal axis of the device 102. The outer faces 28*a*, 28*b* of each rib 29*a*, 29*b* is in abutment with an inner surface of the bores 41*a*, 41*b*.

Figure 9:
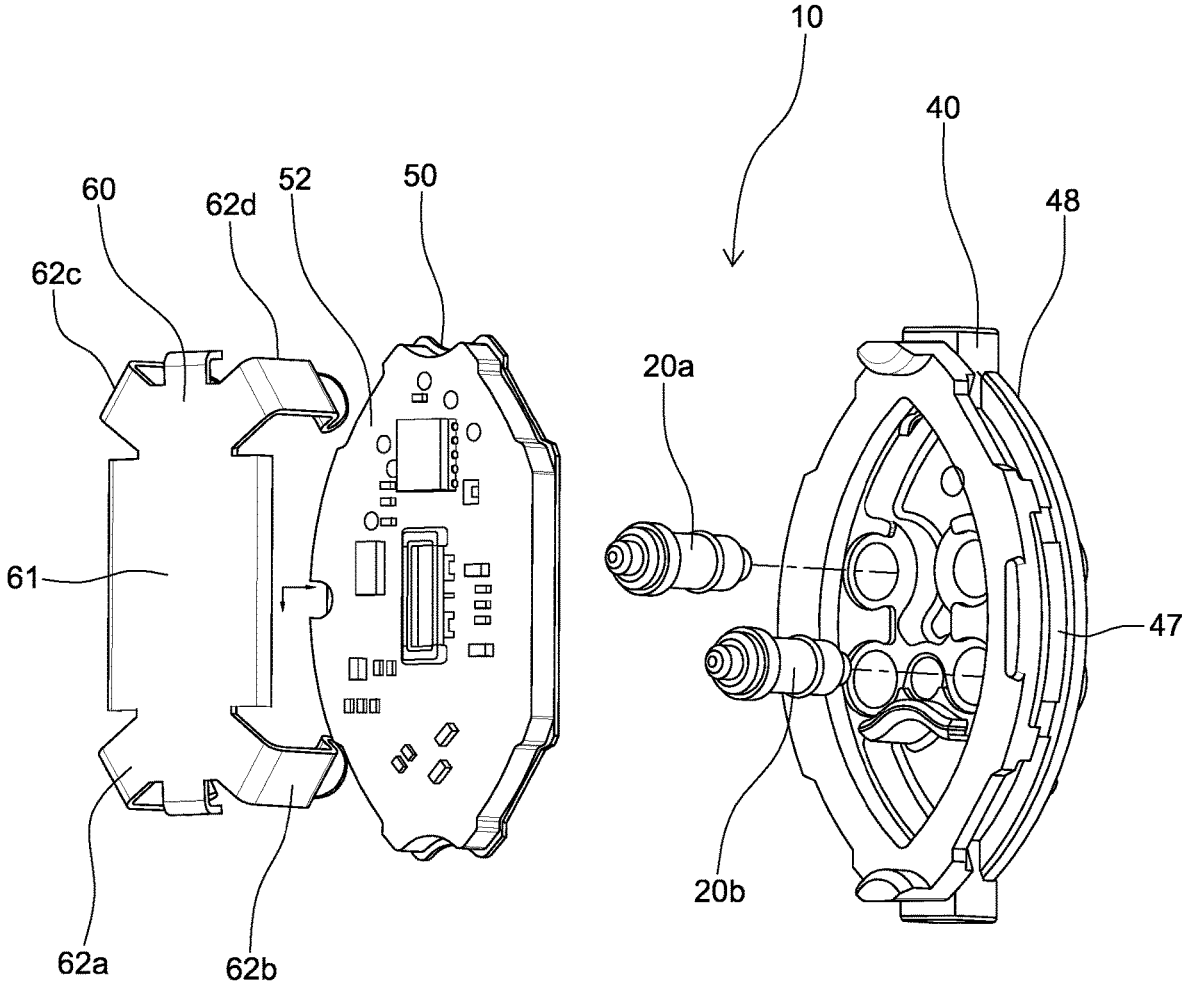
FIG. 9 is an exploded view of the portion of the aerosol delivery device shown in FIG. 7.

As seen in FIGS. 7 and 9, the socket plate 40 comprises a socket plate groove 47 which extends around the entire perimeter of the socket plate 40 on the transverse side 48. The portion 10 of the device 102 also comprises a retention clip 60 configured to resist the expansion of the second heads 22*a*, 22*b* to the extended positions. Best seen in FIG. 9, the retention clip 60 comprises a retention plate 61 which abuts a lower face 52 of the PCB 50 and a plurality of resilient members 62*a-d* which extend from the outer edge of the retention plate 61 in a direction parallel to the longitudinal axis of the device 102. The resilient members 62*a-d* are spaced around the outer edge of the retention plate 61.

Each resilient member 62*a-d* has a protrusion (for example 63*a* shown in FIG. 7) which extends towards the centre of the device 102, is received in the socket plate groove 47 and is secured using a snap-fit connection.

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the invention that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

Aspects and preferred features are further described in the numbered paragraphs below:

1. An aerosol delivery device comprising at least one connector pin, the connector pin having:
   a main body;
   a first head for electrical connection to an aerosol delivery component comprising a vaporizer; and
   a second head for electrical connection to an electrical component within the device, wherein both the first and second heads are biased to extend from the main body.
2. The aerosol delivery device according to paragraph 1 wherein the first head is biased towards an extended position and movable against the bias to a retracted position.
3. The aerosol delivery device according to paragraph 2 wherein the first head comprises a first head end face and wherein, in the extended position, the first head end face and the main body are spaced further apart than in the retracted position.
4. The aerosol delivery device according to any one of paragraphs 1 to 3 wherein the electrical component within the aerosol delivery device comprises a printed circuit board having at least one connection pad and wherein the second head of the/each connector pin is in abutment with the connection pad.
5. The aerosol delivery device according to any one of paragraphs 1 to 4 wherein the first and second heads are spring-loaded.
6. The aerosol delivery device according to any one of paragraphs 1 to 5 wherein the/each connector pin comprises a respective constraining feature which prevents movement of the connector pin relative to the aerosol delivery device in a first longitudinal direction.
7. The aerosol delivery device according to paragraph 6 wherein the constraining feature is a radially protruding flange.
8. The aerosol delivery device according to any one of paragraphs 1 to 7 wherein the/each connector pin comprises a radially protruding rib.
9. The aerosol delivery device according to any one of paragraphs 1 to 8 wherein the main body of the/each connector pin comprises a fillet.
10. The aerosol delivery device according to any one of paragraphs 1 to 9 wherein the aerosol delivery device comprises a socket plate comprising at least one socket plate bore and wherein the/each connector pin extends within a respective one of the at least one socket plate bores.
11. The aerosol delivery device according to paragraph 10 wherein the aerosol delivery device comprises a retention clip configured to resist expansion of the/each biasing element in the second head of the/each connector pin.
12. An aerosol delivery system comprising a device according to any one of the preceding paragraphs 1 to 11 and a component comprising an aerosol precursor.
13. A method of assembling an aerosol delivery device, the device comprising:
    at least one connector pin;
    a socket plate having at least one socket plate bore;
    an electrical component; and
    a retention clip,
    the method comprising the steps of:
    inserting the connector pin into the socket plate bore;

placing the socket plate in abutment with the electrical component;

retaining the electrical component, the socket plate and the connector pin in place with the retention clip such that the connector pin is in electrical contact with the corresponding connection pad.

14. The method of assembling an aerosol delivery device according to paragraph 13, wherein device further comprises a power source and the method further comprises the additional step of electrically connecting the connection pad with the power source.

The invention claimed is:

1. An aerosol delivery device, comprising:

a movement detection unit configured to detect a movement of the device;

a power source having a level of charge; and a feedback element configured to provide feedback based on the charge status of the power source, wherein the feedback element provides feedback in response to a movement of the device being detected by the movement detection unit, wherein the device has a charging mode and the feedback element is configured to only provide feedback when the device is in the charging mode.

2. A device according to claim 1, the device having a charging mode, wherein the feedback element is configured to prohibit the provision of feedback when the device is in the charging mode and when no movement is detected.

3. A device according to claim 1, wherein the movement detection unit is configured to detect a defined movement of the device by a user.

4. A device according to claim 3, wherein the defined movement is indicative of the device being picked up, and/or tapped and/or moved by the user.

5. A device according to claim 1, wherein the movement detection unit is configured to determine a movement parameter and the feedback element is configured to provide feedback when the movement parameter is determined to be above a predetermined movement threshold.

6. A device according to claim 1, the feedback element comprising a light source for emitting an illumination, wherein the light source is configured to produce a first illumination when the level of charge of the power source is above a predetermined charge threshold, and a second illumination when the level of charge is below the predetermined charge threshold.

7. A device according to claim 6, wherein the first and second illuminations comprise different colours.

8. A device according to claim 6, wherein the first and second illuminations comprise different intensities.

9. A device according to claim 6, wherein at least one of the first and second illuminations comprises a pulsed illumination.

10. A device according to claim 9, wherein the first illumination comprises a pulsed illumination having a first frequency, and the second illumination comprises a pulsed illumination having a second frequency, wherein the first pulse frequency is greater than the second pulse frequency.

11. A device according to claim 6, wherein the device comprises a controller configured to control the feedback element to provide at least one visual feedback response, the at least one visual feedback response being selectable from a plurality of visual feedback responses which are stored in a memory.

12. A device according to claim 1, wherein the feedback element is configured to provide feedback for a predetermined period of time before turning off.

13. A device according to claim 12, wherein the feedback element is configured to turn off the feedback after substantially three seconds.

14. An aerosol delivery system, comprising: an aerosol delivery device as defined in claim 1, and a consumable component for receipt in the aerosol delivery device.

15. An aerosol delivery device, comprising:

a movement detection unit configured to detect a movement of the device;

a power source having a level of charge; and a feedback element configured to provide feedback based on the charge status of the power source, wherein the feedback element provides feedback in response to a movement of the device being detected by the movement detection unit, the feedback element comprising a light source for emitting an illumination, wherein the light source is configured to produce a first illumination when the level of charge of the power source is above a predetermined charge threshold and a second illumination when the level of charge is below the predetermined charge threshold, wherein the first illumination comprises a pulsed illumination having a first frequency and the second illumination comprises a pulsed illumination having a second frequency, and wherein the first pulse frequency is greater than the second pulse frequency.

* * * * *